US005415329A

United States Patent [19]

Westlund

[11] Patent Number: 5,415,329

[45] Date of Patent: May 16, 1995

[54] CONTAINER INCLUDING A PRESSURE RELIEF VALVE FOR USE IN HOLDING AND DISPENSING SOFT DRINK MATERIAL

[75] Inventor: David L. Westlund, Green Bay, Wis.

[73] Assignee: Tosca Limited, Green Bay, Wis.

[21] Appl. No.: 81,439

[22] Filed: Jun. 22, 1993

[51] Int. Cl.[6] ..... B65D 83/00

[52] U.S. Cl. ..... 222/397; 222/400.7

[58] Field of Search ..... 222/396, 397, 400.7, 222/400.8

[56] References Cited

U.S. PATENT DOCUMENTS

| | | | |
|---|---|---|---|
| 888,488 | 5/1908 | Gurley | 222/397 X |
| 928,374 | 7/1909 | Ford et al. | 222/397 X |
| 1,009,980 | 11/1911 | Leisure et al. | 222/397 |
| 1,866,285 | 7/1932 | Albertine | 222/397 X |
| 2,081,022 | 5/1937 | Smith | 222/397 X |
| 2,086,000 | 7/1937 | Roren | 222/397 X |
| 2,400,955 | 5/1946 | Samel | 222/397 X |
| 3,076,576 | 2/1963 | Cornelius . | |
| 3,186,577 | 6/1965 | Tennison . | |
| 3,329,299 | 7/1967 | Atkinson et al. . | |
| 3,823,718 | 7/1974 | Tromovitoh | 222/397 X |
| 5,199,609 | 4/1993 | Ash, Jr. | 222/400.7 X |

*Primary Examiner*—Andres Kashnikow
*Assistant Examiner*—Kenneth H. DeRosa
*Attorney, Agent, or Firm*—Godfrey & Kahn

[57] ABSTRACT

A container 10 for use in holding and dispensing soft drink material comprises a cylindrical body (12), a key valve (34), and a pressure relief valve (28). The cylindrical body (12) is of a type which has been commercially used by the soda beverage industry in the past and has been retrofitted by installation of the valve (34) and the pressure relief valve (28). The valve (34) is a single key or tap valve such as employed by the beer industry, and operates to simultaneously withdraw the soft drink material and introduce carbon dioxide. The pressure relief valve (28) includes a tube (100) with a passageway (114), a coil spring (104), and a ball (102). When pressure in the cavity exceeds a selected threshold amount, the biasing of the spring (104) is overcome to open the passageway (114) and thereby release pressure along a path of fluid communication.

12 Claims, 8 Drawing Sheets

CONTAINER INCLUDING A PRESSURE RELIEF VALVE FOR USE IN HOLDING AND DISPENSING SOFT DRINK MATERIAL

FIELD OF THE INVENTION

The present invention generally relates to commercially available soft drink beverage containers for dispensing of such beverage, and more specifically to retrofitted containers which employ a pressure relief valve and the method of fabricating the same.

BACKGROUND OF THE INVENTION

The soda industry has employed a reusable twenty liter stainless steel cylinder for commercial dispensing of soda beverages for many years. This reusable container has an opening and a removable oval lid that allows the inside of the container to be cleaned and refilled. Within the last ten years an innovation has been introduced which has been termed a "bag in the box" system. This product was introduced to the industry for post-mix soda. The "bag in the box" system has largely replaced the reusable stainless steel container for certain post-mix applications, however, the reusable container is still used in all pre-mix applications and some specific post-mix situations.

The reusable container has certain inherent drawbacks inasmuch as it presents readily identifiable problems of sanitation and labor inefficiencies. For example the oval lid is removable, and consequently foreign matter can enter the container and contaminate the soda product. Further, the reusable container is difficult and time consuming to clean by hand and filling the containers is labor intensive. On the other hand, the "bag in the box" system has the drawback that it is not reusable. Additionally, the adoption of the "bag in the box" system has resulted in a large number of containers which have no current use and which are standing idle.

Accordingly, a need has arisen for an improved container which is a "closed" system which maintains a sanitary condition for the soft drink beverage material contained therein, and which further requires a minimum amount of labor to maintain such sanitary state. Further, a need has arisen for a use for the reusable twenty liter stainless steel cylinder containers which were formerly employed in the soda industry and which have begun to fall out of favor.

SUMMARY OF THE INVENTION

In accordance with the present invention, a container for use in holding and dispensing of a soft drink syrup or pre-mix material includes a cylindrical body; a single keg valve; and at least one pressure relief valve. The cylindrical body is of a type which has been commercially used in the past and which has a top and a bottom, the body defining an interior surface and an exterior surface, and the interior surface of the body further defining a cavity within which the soft drink material may be held. The body further defines an opening and also includes an oval lid and two ports in the top which extend between the interior surface and the exterior surface.

The container described above is retrofitted by removing the oval lid from the opening and the valves which are individually associated with the two ports. A single keg valve is installed into the opening, the keg valve operating in a fashion which is analogous to a beer keg/tap valve and which simultaneously withdraws the soft drink material and which permits the introduction of carbon dioxide.

The previously employed containers are further retrofitted by fitting one or both of the ports with pressure relief valves. If one pressure relief valve is used the other port is sealed. Under most operational conditions, the pressure relief valve is normally closed, but the valve will open when fluid pressure in the cavity of the container exceeds a predetermined level. In this regard, the pressure relief valve includes a tube which defines a passageway; a biasing means such as a spring is received in the passageway, and a stop or ball selectively occludes the passageway. When pressure in the cavity exceeds a threshold amount, the biasing means is overcome and the stop is moved along a path of travel to open the passageway and thereby release pressure along a path of fluid communication to the ambient environment.

The container of the present invention and which is used in holding and dispensing soft drink material is a "closed" system and thereby prevents the introduction of foreign matter into the soft drink material within. Further, the container of the present invention is a retrofitting of the previously employed stainless steel cylinder containers thereby providing a new use for such containers which are now standing idle. The container of the present invention accomplishes these and other desirable objectives without compromising performance, while simultaneously avoiding the detriments which have been associated with the prior art practices.

Further objects, features, and advantages of the present invention will be apparent from the following detailed description taken in combination with the accompanying drawings.

DETAILED DESCRIPTION OF THE PREFERRED EMBODIMENT

Figure 1:
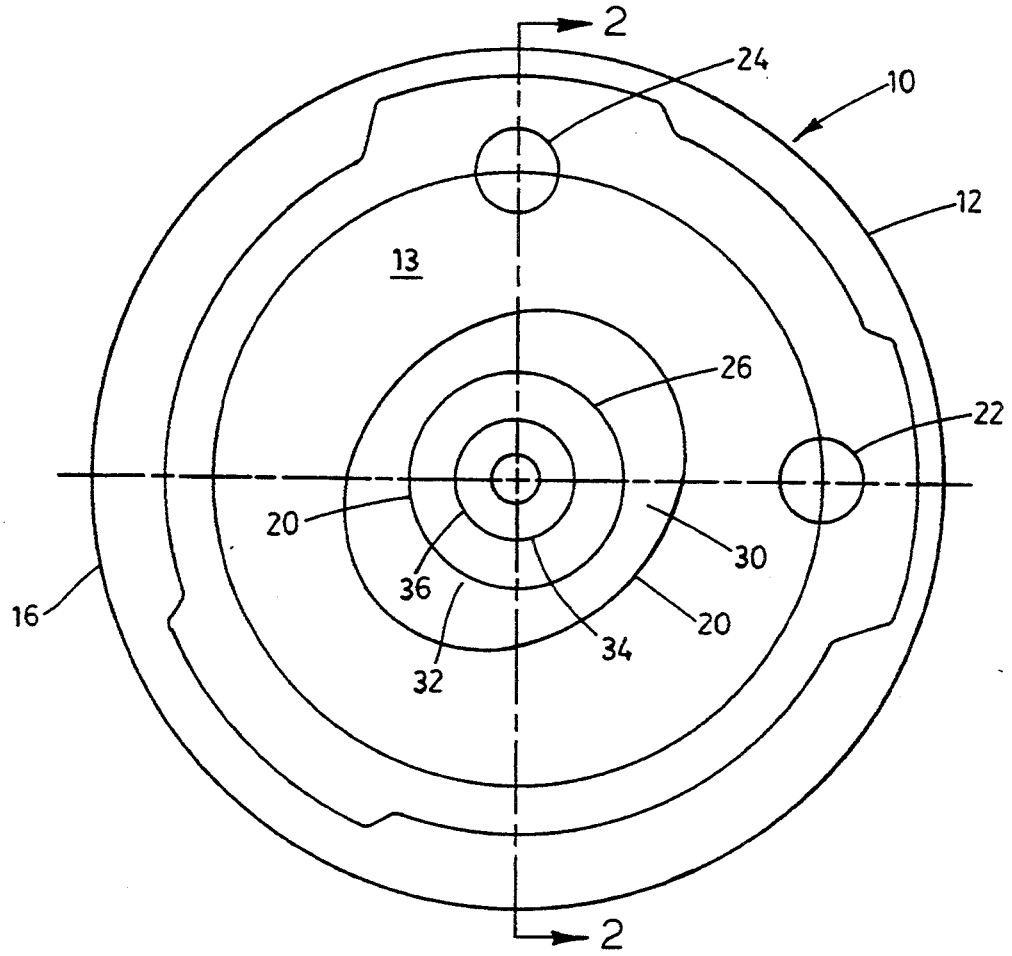
FIG. 1 is a plan view of the container for use in holding and dispensing soft drink syrup or pre-mix material of the present invention.
Figure 2:
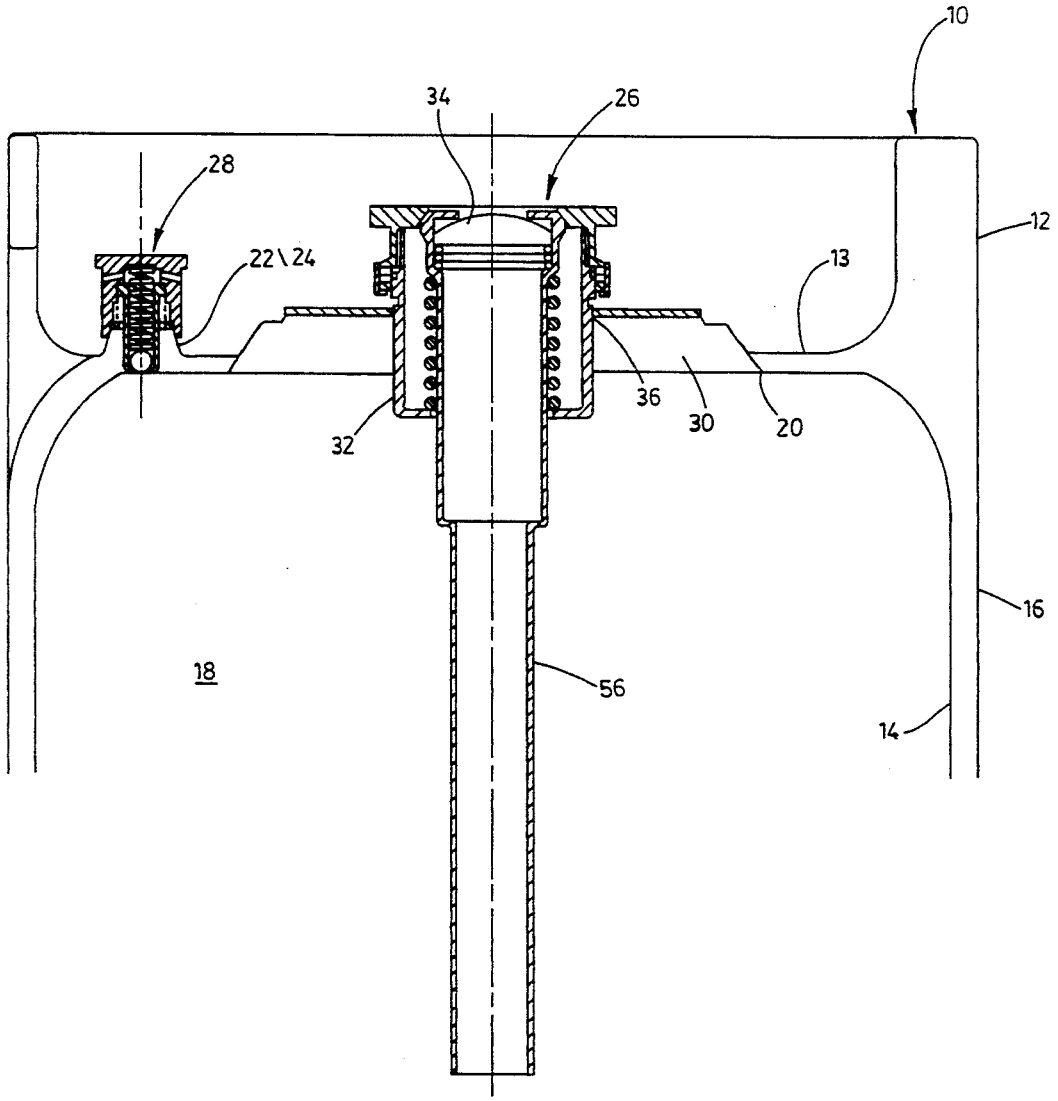
FIG. 2 is a fragmentary, longitudinal, vertical sectional view taken along line 2—2 of FIG. 1 and which illustrates the container for use in holding and dispensing soft drink syrup or pre-mix material of the present invention.

With reference to the drawings, a container for use in holding and dispensing soft drink syrup or pre-mix material in accordance with the present invention is shown generally at the numeral 10 in FIGS. 1 and 2. The container 10 includes a cylindrical body 12 having a top surface 13, and a bottom surface (not shown) which axially opposes the top surface 12. The cylindrical body 12 defines an interior facing surface 14, and an exterior facing surface 16. The interior facing surface 14 defines a cavity 18 within which the soft drink syrup or pre-mix material may be held. The cylindrical body 12 further includes an opening 20; a first port 22; and a second port 24 each of which individually extend between the interior facing surface 14 and the exterior facing surface 16.

As discussed earlier, the container 10 is a retrofit of a prior art twenty liter stainless steel cylindrical container which was employed heretofore for dispensing a soda beverage product. Containers of this design have been commercially used for many years. In the container of the prior art, an oval lid or closure (not shown) sealingly fits in mating receipt over the opening 20 and clamps in place to occlude the opening 20. The oval lid is a subassembly of a clamping assembly (not shown) which is made integral with the top surface 13 of the prior art container. The container of the prior art further has individual valves (not shown) which are connected in fluid flowing relation at each of the ports 22 and 24. One of the ports and its associated valve is utilized for withdrawing syrup from the cavity 18 of the container and the other port and its associated valve is used for introducing carbon dioxide into the cavity 18. U.S. Pat. No. 3,076,576 issued to Cornelius on Feb. 5, 1963; U.S. Pat. No. 3,186,577 issued to Tennison on Jun. 1, 1965; and U.S. Pat. No. 3,329,299 issued to Atkinson, et al., on Jul. 4, 1967, are examples of the container of the prior art and the descriptions of these containers are incorporated by reference herein. The container 20 of the present invention is a modification of the prior art container. More specifically the container is modified, initially by removal of the oval lid at the opening 20 and the valves (not shown) which are normally located at the ports 22 and 24. Further, a keg or tap valve assembly 26 of conventional construction is installed within the opening 20, and a pressure relief valve 28 is installed in at least one of the ports 22 or 24.

Figure 3:
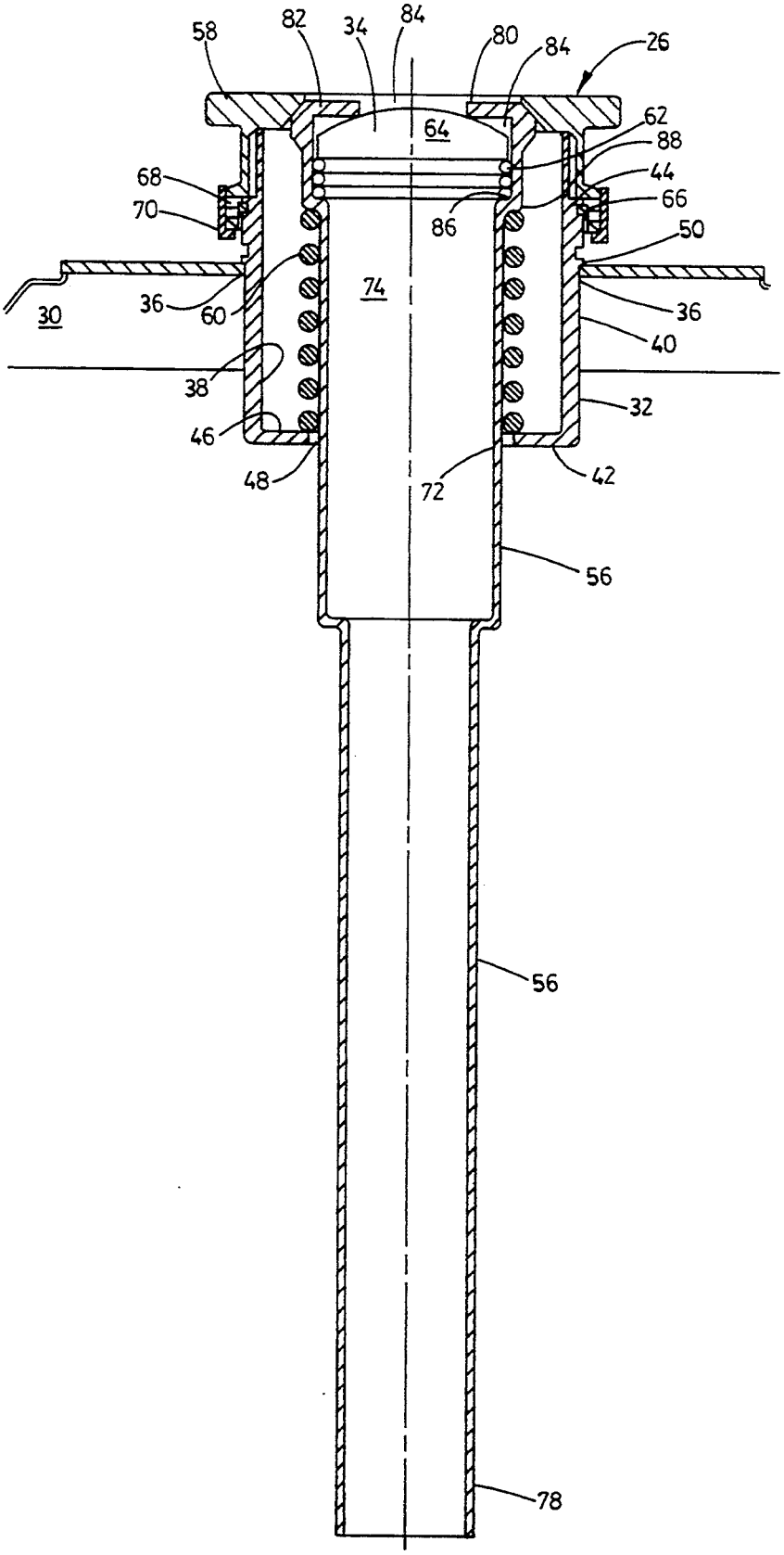
FIG. 3 is a fragmentary, somewhat enlarged longitudinal, vertical sectional view of the valve assembly depicted in FIG. 2 and which is installed within the opening of the container of the present invention.
Figure 4:
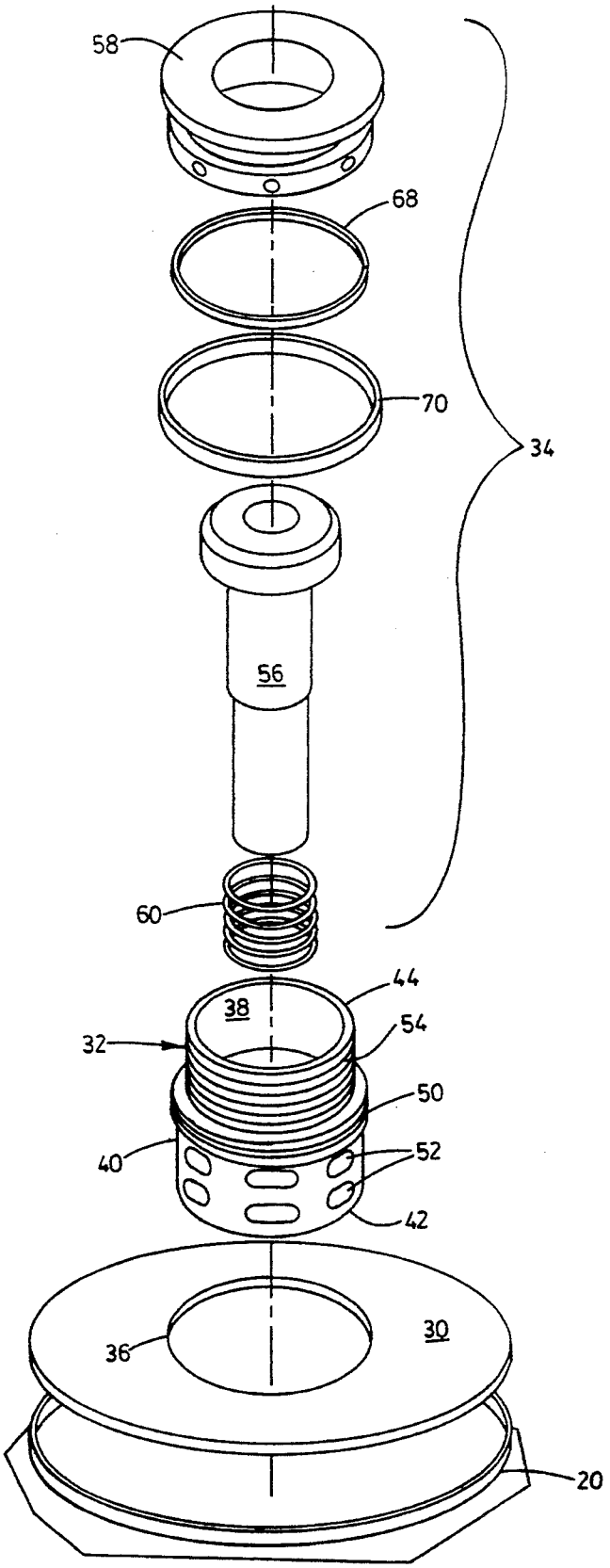
FIG. 4 is a fragmentary, exploded, perspective view of the valve assembly depicted in FIG. 3.

As shown in FIGS. 3 and 4, the valve assembly 26 includes an oval tap adaptor 30, a basket 32, and a valve 34. The tap adaptor 30 is welded or otherwise secured by a suitable fastening technique which provides a substantially fluid impervious seal to the opening 20. The adaptor includes an aperture 36 which matingly receives the basket 32, and the valve 34 therein. The basket 32 includes an inside diametral boundary 38; an outside diametral boundary 40; a first end 42; and a second end 44 which axially opposes the first end 42. The first end 42 includes a bottom portion 46 which defines an aperture 48 which has a predetermined diametral dimension which is less than the inside diametral boundary 38. Intermediate the first end 42 and the second end 44 is a circumferential lip 50 of increased diametral dimension in relative comparison to the outside diametral boundary 40. Further, between the lip 50 and the first end 42 the outside diametral boundary defines a plurality of radially-directed holes 52. Disposed between the lip 50 and the second end 44, the outside diametral boundary defines a plurality of threads 54. As seen in the drawing, the basket 32 is nested within the aperture 36 of the tap adaptor 30 such that the outside diametral boundary 40 matingly fits within the aperture 36 and the lip 50 abuts in juxtaposed relation against the circumferential edge of the aperture 36. The basket 32 is normally welded in place on the oval tap adaptor 30. An example of a suitable basket for use as the basket 32 is manufactured by Micro Matic A/S of Odense, Denmark and is commercially available through Micro Matic USA, Inc. of Northridge, Calif.

The valve 34 is a single valve, as opposed to the container of the prior art which employed a two valve system, (as discussed earlier) the first valve being associated with one of the ports 22 or 24 for withdrawal of syrup, and the second valve being associated with the other valve for introduction of carbon dioxide. The valve 34 operates on the same principle as a beer keg or tap valve. The valve 34 includes a pipe portion 56; a nut 58; a first coil spring 60; a second coil spring 62; a dome member 64; an 0-ring gasket 66; a stainless steel internal snap ring 68; and a tamper-evident ring 70. The pipe portion 56 is substantially cylindrical and has an inside diametral boundary 72 which defines a passageway 74; an outside diametral boundary 76; a first end 78 and a second end 80 that axially opposes the first end 78. The passageway 74 extends between the first end 78 and the second end 80. The pipe portion 56 includes an inwardly disposed flared portion 82 at the second end 80 such that the passageway 74 terminates in an aperture 84 having a reduced diametral dimension in relative comparison to the remainder of the inside diametral boundary 72. The inside diametral boundary 72 further includes a region 84 which has a greater diametral dimension in relative comparison to the remainder of the passageway 74 in the area adjacent to the inwardly disposed flared portion 82. The change in inside diametral dimension between the region 84 and the remainder of the passageway 74 occurs at a circumscribing step 86. Further, a corresponding change in the outside diametral boundary 76 occurs at a circumscribing step 88.

The valve 34 is generally assembled as follows. The outside diametral boundary 76 of the pipe portion 56 fits within the aperture 48 of the basket 32. The first coil spring 60 is telescopingly received about the outside diametral boundary 76 of the pipe portion 56 and is oriented between the end portion 46 and the step 88. The dome member 64, and the second coil spring 62 are matingly received within the region 64 such that the second coil spring 62 rests against the circumscribing step 86. The second coil spring 62 is operable to bias the hemispherical portion upwardly thereby occluding the aperture 84. Threads made integral with the nut 58 matingly interact with the threads 54 of the basket 32, and further is operable to engage the second end 80 of the pipe portion 56. Upon threaded engagement of the nut 58 with the basket 32, the first coil spring 60 biases the second end of the pipe portion 56 against the nut 58. The 0-ring gasket 66 and the snap-ring 68 are matingly received in interfitted relation about the lip 50 of the basket 32, and the tamper-evident ring 70 matingly fits about the boundary defined between the snap-ring 68 and the nut 58 such that any tampering or attempted disassembly of the valve 34 would be reflected in an adulterated tamper-evident ring 70.

An example of a suitable commercially available keg valve for use as the valve 34 is manufactured by Micro Matic A/S of Odense, Denmark and which is available for purchase through Micro Matic USA, Inc. of Northridge, Calif. As noted above, the valve 34 is of a keg variety, and the dispensing of soda beverage material is analogous to the tapping of a beer keg. Generally, a rod coupler penetrates the passageway 74 by depressing the dome member 64 against the second coil spring 62. Fluid communication is thereby established between the aperture 74 and the first end 78 of the pipe portion 56. The passageway 74 acts as a fluid conduit to the cavity 18 of the container 10. Carbon dioxide gas is introduced into the cavity 18 of the container 10 and the soft drink syrup or pre-mix material contained therein is simultaneously withdrawn. The principles of operation of beer keg/tap valves are generally well-known, and are not further discussed herein.

Figure 5:
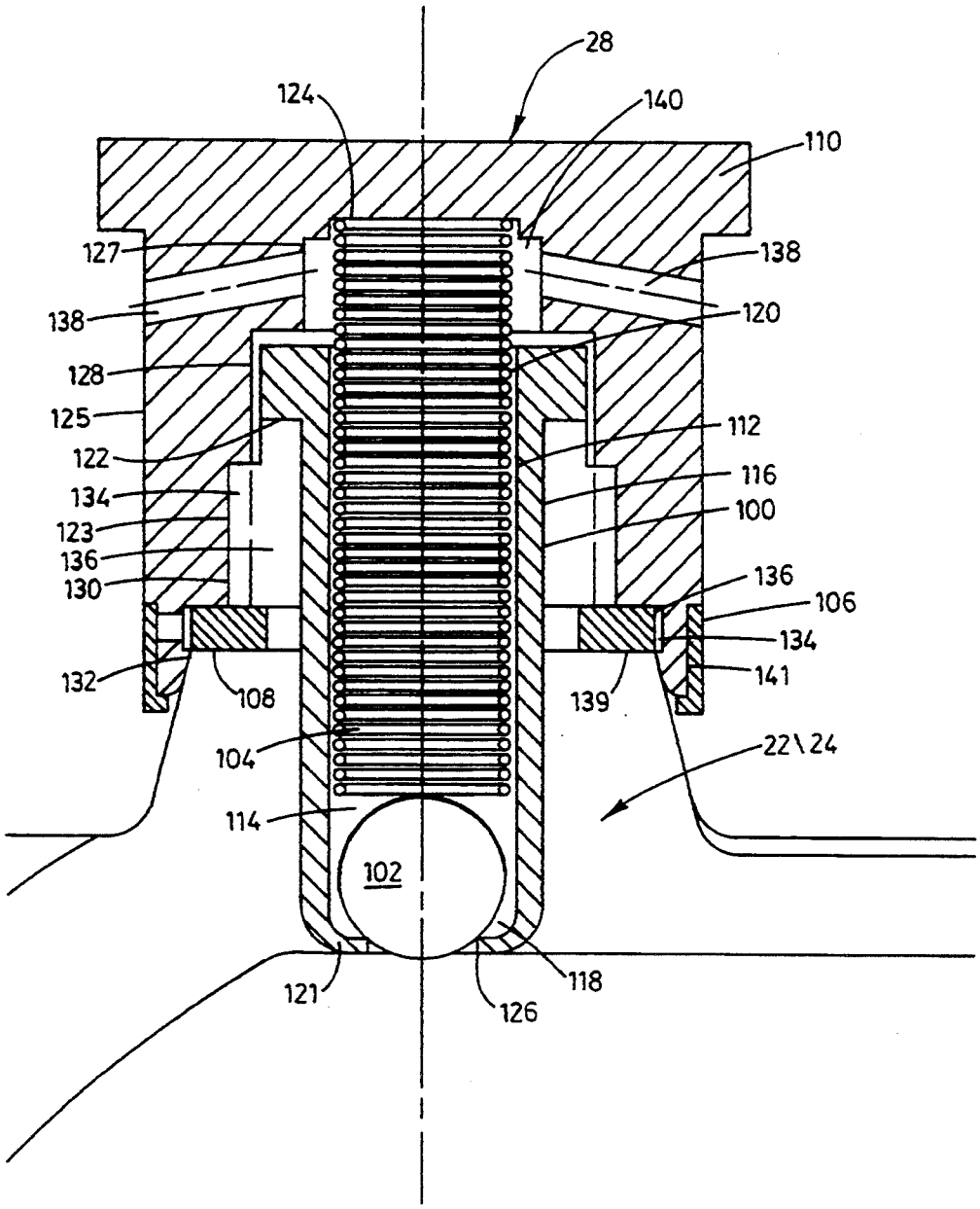
FIG. 5 is a fragmentary, greatly enlarged, longitudinal, vertical sectional view of the pressure relief valve depicted in FIG. 2 and which is installed in one of the ports of the container of the present invention.
Figure 6:
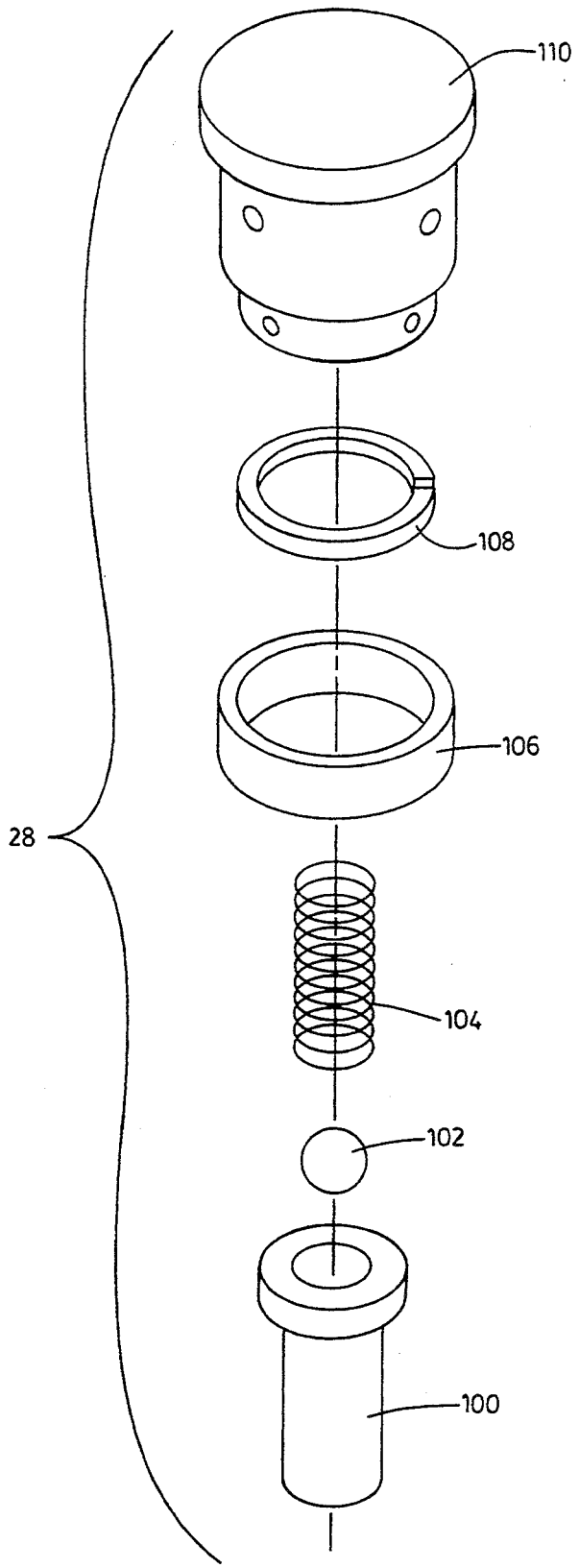
FIG. 6 is a fragmentary, enlarged, exploded, perspective view of the pressure relief valve depicted in FIG. 5.

As shown in FIGS. 5 and 6, the pressure relief valve 28 includes a tube 100; a stainless steel ball 102; a stainless steel coil spring 104, a tamper-evident ring 106, a stainless steel internal snap ring 108 and a nut 110. The tube 100 is substantially cylindrical and has an inside diametral boundary 112, which defines a passageway 114; an outside diametral boundary 116; a proximal end 118; and a distal end 120, that axially opposes the proximal end 118. The passageway 114 extends between the proximal end 118 and the distal end 120. The tube 100 includes a circumscribing step or lip 122 at the distal end 120 which has a greater diametral dimension in relative comparison than the remainder of the outside diametral boundary 116. The tube 100 further includes an inwardly disposed flared portion 121 which is located at the proximal end 118. The flared portion defines an aperture 126 having a diametral dimension less than the remainder of the inside diametral boundary 112. A suitable material for the tube 100 is manufactured under the tradename of Celcon ®.

The stainless steel ball 102 has a predetermined diametral dimension such that it movably fits within and is operable to travel between, the proximal and distal ends 118 and 120 of the passageway 114. The stainless steel ball 102 has a diametral dimension which is larger than the aperture 126 such that when the stainless steel ball is moved or urged toward the proximal end 118 of the tube 100, the ball 102 substantially occludes the aperture 126.

The nut 110 has an inside boundary 123, and an outside boundary 125. The inside boundary 123 includes an end portion 124; a first diametral step 127; a second diametral step 128; a third diametral step 130; and a fourth diametral step 132. The third diametral step 130 includes a plurality of threads 134 which screwthreadably mate with the threads 136 which are made integral with the container 10 in the region of the individual ports 22 or 24. The fourth diametral step 132 includes an indentation 139, within which the snap ring 108 conformably fits. The snap ring 108 fits conformably about the individual ports 22 or 24. The outside boundary 125 includes an indentation 141 within which the inside diameter of the tamper-evident ring 106 fits. The nut 110 also defines a plurality of radial holes 138 which extend between the inside boundary 120 in the region of the first step 126 and the outside boundary 122.

The stainless steel coil spring 104 is telescopingly received within the passageway 114 of the tube 100. The threads 134 of the nut 110 screwthreadedly engage the threads 136 of the container 10 such that one end of the spring 104 is biased against the end portion 124, and the axially opposed end of the spring 104 biases the stainless steel ball 102 in occluding relation relative to the aperture 126. The stepped arrangement of the inside boundary 120 of the nut 110 is such that upon the screwthreadable engagement of the threads 134 with the threads 136 of the container 10, the inside boundary 123 of the nut 110 conformably fits about the tube 100. More specifically, the second diametral step 128 of the inside boundary 123 of the nut 110 fits about the lip 122 of the tube 100. Further, and upon the screwthreadable engagement of the threads 134 and 136, a cavity 140 is formed in the region of the first step 126 where the radial holes 138 intersect with the inside boundary 120. The snap-ring 108 is matingly received about the outside boundary 125, and the tamper-evident ring 106 fits about the boundary defined between the outside boundary 122 of the nut 110 and the container 10 in the region of either of the ports 22 and 24, such that any tampering would be reflected in an adulterated tamper-evident ring 106.

The stainless steel spring 104 is selected to be of a spring constant and length such that a force of a preselected threshold urges the stainless steel ball 102 from its occluding orientation at the proximal end 118, towards the distal end 120. The urging of the stainless steel ball 102 towards the distal end 120 of the tube 100 permits fluid communication along a path which begins at the aperture 126 of the tube, and extends through the passageway 114 into the cavity 140, and through the radially oriented holes 138. The pressure relief valve 28 is operable to release pressure in the container 10 which exceeds a pre-selected threshold when the pressure urges the ball 102 away from the aperture 126 thereby allowing the escape of pressure.

Figure 7:
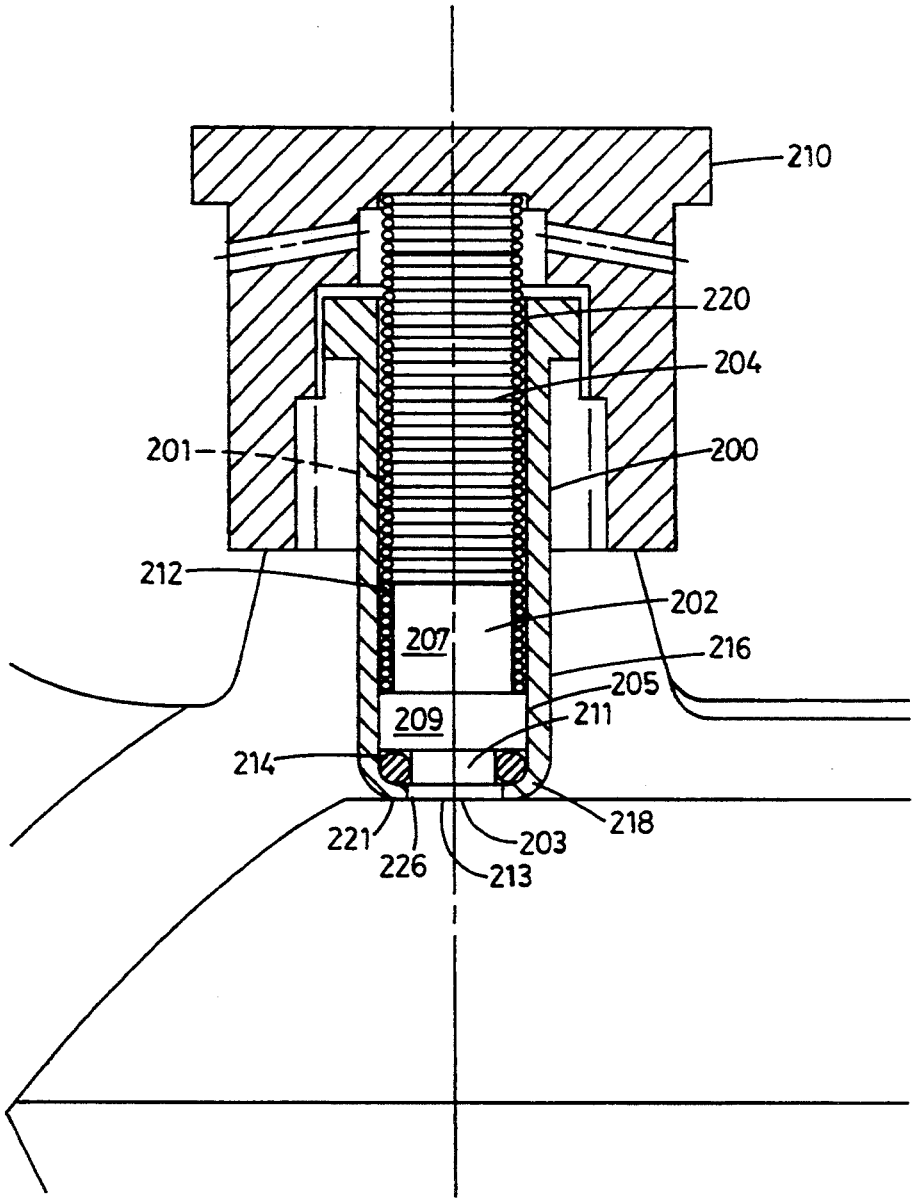
FIG. 7 is a fragmentary, enlarged, longitudinal sectional view of an alternative form of the pressure relief valve which is installed in one of the ports of the container of the present invention, the coil spring being partially removed to illustrate the structure of a plunger which is made integral therewith.
Figure 8:
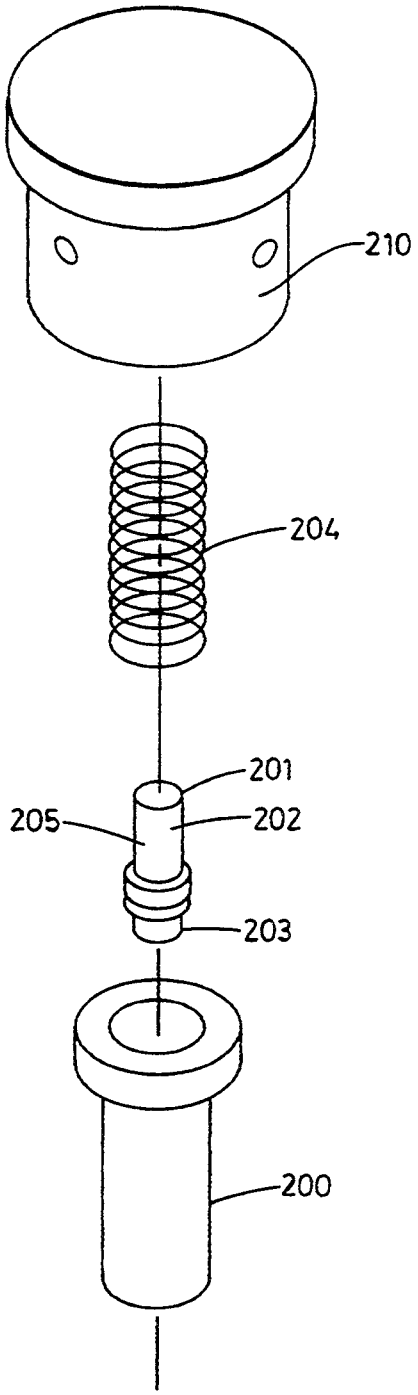
FIG. 8 is an exploded, perspective view of the alternative form of the pressure relief valve depicted in FIG. 7.

FIGS. 7 and 8 illustrate an alternate embodiment of a pressure relief valve 28A which includes a tube 200; a plunger 202; a stainless steel coil spring 204; and a nut 210. The tube 200; the plunger 202; the stainless steel coil spring 204; and the nut 210 are analogous to the tube 100; the plunger 102; the stainless steel coil spring 104; and the nut 110 as described above, and except where noted, the general description as it relates to the embodiment of FIGS. 5 and 6 is not repeated herein and applies to the alternate embodiment as shown in FIGS. 7 and 8. It should be understood that the valve shown at FIGS. 7 and 8 does not depict a tamper-evident ring or an internal snap ring. However, it should be understood that either embodiment of the valve may be manufactured with or without a tamper-evident ring or an internal snap ring.

The tube 200 is substantially cylindrical and has an inside diametral boundary 212, which defines a passageway 214; an outside diametral boundary 216; a proximal end 218; and a distal end 220 which axially opposes the proximal end 218. The passageway 214 extends between the proximal end 218 and the distal end 220. The tube 200 further includes a circumscribing step or lip 222 at the distal end 220, and which has a greater diametral dimension than the diametral dimension of the outside diametral boundary 216. The tube 200 further includes an inwardly flared portion 221 which is located at the proximal end 218. The flared portion defines an aperture 226 having a diametral dimension which is less than the diametral dimension of the inside diametral boundary 212.

The plunger 202 includes a first end 201; a second end 203 which axially opposes the first end 205; and an outside diameter 205. Beginning at the first end 203; the outside diameter 205 includes a first diametral dimension 207; a second diametral dimension 209; a third diametral dimension 211; and a fourth diametral dimension 213. The first diametral dimension 207 is dimensioned so as to be telescoping received within the stainless steel coil spring 204. The second diametral dimension 209 is dimensioned so as to telescopingly fit within the passageway 214 and further have sufficient clearance between the proximal and distal ends 218 and 220 to permit travel without hindrance. The third diametral dimension 211 is dimensioned to be smaller than the second diametral dimension 209 thereby permitting an 0-ring 215 to be fitted or received about its circumference. The fourth diametral dimension 213 is dimensioned so as to matingly fit within the aperture 226 and thereby occlude the aperture 226 when the plunger 202 is moved or urged toward the proximal end 218 of the tube 200.

The stainless steel spring 204 is selected to be of a spring constant and length such that a force of a preselected threshold urges the plunger 202 from the proximal end 218 toward the distal end 220. The urging of the plunger 202 toward the distal end 220 of the tube 200 permits fluid communication along a path which begins at the aperture 226 of the tube, and extends through the passageway 214, into the cavity, and outwardly through the radial holes. The pressure relief valve 28A may thereby release pressure in the container 10 which exceeds a preselected threshold by urging the plunger 202 away from the aperture 226.

The retrofitting of the prior art container to fabricate the container 10 of the present invention is accomplished according to the following method. First, all internal pressure is released from the container and the oval lid and gas and syrup valves are removed. The container is then rinsed inside and out by utilizing a 90-second caustic wash to remove any contaminants. The caustic waste is then followed by a 45-second fresh water rinse. The opening 20 is then re-sized to ensure uniformity of fitted parts and welding, the opening 20 is further finished or surfaced to further ensure proper fitting with the oval tap adaptor 30.

The basket 32 is then welded to the oval tap adaptor 30, the parts being held in a welding jig turntable and then tig-pulse welded, shielded with argon, and backed with nitrogen. The resultant welds are then buffed.

The combination basket 32 and oval tap adaptor 30 is then welded to the opening 20 of the container. The basket 32/oval tap adaptor 30 is fitted in a tacking jig, the container is purged for 60 seconds, and the basket 32/oval tap adaptor 30 is tack welded to the opening 20 in four spots. The container is then placed in a welding turntable and a welding jig head is then inserted therein. The container is again purged with nitrogen for 60 seconds, and the tacked parts are then completely tig-pulse welded with an argon gas shield. The resultant welds are then buffed, and all welds are closely inspected inside and out.

The pressure relief valve 28 is installed within at least one of the ports 22 and 24 and the other port is sealed. The stainless steel internal snap ring 104 is then installed, and the tube 100 is press-fitted within one of the ports 22 or 24. The stainless steel ball 102 and the stainless steel coil spring 104 are inserted into the passageway 114, and the nut 110 and the tamper-evident ring 106 are tightened to 15 foot pounds. The retrofitted container 10 is then leak tested to 30 PSI with compressed air, and the container 10 is then submerged under water and inspected for air leaks.

In the operation of the container 10, the valve 34 functions in a manner analogous to a beer keg/tap valve, as described above, to dispense soda beverage. The pressure relief valve 28 will release fluid contents of the container 10 through the radial holes 138 when pressure within the cavity 18 of the container 10 exceeds a threshold amount. As indicated above, under such circumstances, the stainless steel ball is urged toward the distal end 120 of the tube 100, thereby permitting fluid communication from a path beginning at the aperture 126 of the tube 100, through the passageway 114 in and around the coil spring 104, into the cavity 140, and through the radial holes 138.

It is to be understood that the invention is not confined to the particular construction and arrangement of parts herein illustrated and described, but embraces such modified forms thereof as come within the scope of the following claims.

What is claimed is:

1. A container for use in holding and dispensing soft drink syrup or pre-mix material, the container comprising:

(a) a cylindrical body having top and bottom surfaces and interior and exterior surfaces, and wherein the interior surface of the body defines a cavity within which the material may be held, the body having only a single opening and a single port formed in the top surface, and wherein the opening and the port each extends between the interior and the exterior surfaces;

(b) a single valve installed within the opening, the valve being operable to dispense the material and simultaneously introduce carbon dioxide; and (c) a pressure relief valve which is installed in the port, the pressure relief valve being normally closed and wherein the pressure relief valve opens when pressure in the cavity exceeds a predetermined magnitude.

2. The container of claim 1 and wherein the pressure relief valve further comprises:

(a) a tube having a proximal end, a distal end which opposes the proximal end, and a passageway therebetween;

(b) a stop received in the passageway, and wherein the proximal end of the tube is disposed in fluid communication with the port, and wherein the tube includes a vent hole which is in fluid communication with the passageway such that the vent hole is in fluid communication with the port when the stop is disposed in nonoccluding relation relative to the port; and (c) means for biasing the stop into occluding relation relative to the port to prevent fluid communication through the port, the stop being urged toward the distal end of the tube when the pressure in the cavity exceeds a predetermined amount, and wherein movement of the stop toward the distal end of the tube permits fluid communication from the port to the vent hole.

3. The container of claim 2 and herein the passageway is substantially cylindrical and the stop is a ball.

4. The container of claim 2, and wherein the stop is a plunger.

5. The container of claim 2, and wherein the tube further includes a nut which is disposed in juxtaposed relationship relative to the distal end of the tube, and wherein the vent hole is formed in the nut.

6. The container of claim 2, and wherein the means for biasing is a coil spring and the predetermined pressure at which the stop is urged into nonoccluding relation relative to the port is determined by the spring constant of the coil spring.

7. An improved container for use in holding and dispensing soft drink syrup or pre-mix material, the container of a type which includes a cylindrical body having top and bottom surfaces, and wherein the body further includes an interior surface and an exterior surface, and wherein the interior surface of the body defines a cavity within which the material may be held, the body defining an opening which is selectively occluded by an oval lid and further defining two ports in the top surface which individually extend between the interior surface and the exterior surface, and wherein one of the two ports has been previously used for withdrawing the material and the other of the two ports has been used previously for introducing carbon dioxide into the container, the improvement comprising:

(a) a valve which is installed within the opening, the valve being operable to simultaneously dispense the material and introduce a source of gas to the cavity, and Wherein the oval lid is removed prior to the installation of the valve; and (b) a pressure relief valve which is installed in at least one of the ports, and wherein the other port is sealed, and wherein the pressure relief valve is normally closed and the pressure relief valve opens when pressure in the cavity exceeds a pre-selected amount.

8. The container of claim 7, and wherein the pressure relief valve further comprises:

(a) a tube having a proximal end, a distal end which opposes the proximal end, and a passageway therebetween, and wherein the proximal end of the tube is disposed in fluid communication with the port, (b) a stop disposed in the passageway, and wherein the tube includes a vent hole which is in fluid communication with the passageway such that the vent hole is in fluid communication with the port when the stop is disposed in nonoccluding relation relative to the port; and (c) means for biasing the stop into occluding relation relative to the port thereby impeding fluid communication through the port, the stop being urged toward the distal end of the tube when the pressure in the cavity exceeds a predetermined amount, and wherein movement of the stop toward the distal end of the tube permits fluid communication from the port to the vent hole.

9. The container of claim 6, and wherein the passageway is cylindrical and the stop is a ball.

10. The container of claim 6, and wherein the stop is a plunger.

11. The container of claim 7, and wherein the tube further includes a nut which is disposed in juxtaposed relationship relative to the distal end of the tube, and wherein the vent hole is formed in the nut.

12. The container of claim 7, and wherein the means for biasing the stop into occluding relation relative to the port is a coil spring and the predetermined pressure at which the stop is urged into the nonoccluding orientation relative to the port is determined by the spring constant of the coil spring.

* * * * *